US008727697B2

(12) United States Patent
Eifert

(10) Patent No.: US 8,727,697 B2
(45) Date of Patent: May 20, 2014

(54) VARIABLE VANE ACTUATION SYSTEM AND METHOD

(75) Inventor: Andy Eifert, Indianapolis, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 1366 days.

(21) Appl. No.: 12/748,381

(22) Filed: Mar. 27, 2010

(65) Prior Publication Data

US 2013/0039735 A1 Feb. 14, 2013

(51) Int. Cl.
*F04D 27/02* (2006.01)

(52) U.S. Cl.
USPC ..... 415/1; 415/160

(58) Field of Classification Search
USPC ..... 415/148, 151, 159, 160, 162, 163, 164, 415/165
See application file for complete search history.

(56) References Cited

U.S. PATENT DOCUMENTS

| | | | | |
|---|---|---|---|---|
| 1,941,361 | A * | 12/1933 | Moody | 60/686 |
| 3,841,790 | A * | 10/1974 | Stein et al. | 415/159 |
| 5,044,879 | A * | 9/1991 | Farrar | 415/150 |
| 6,269,642 | B1 | 8/2001 | Arnold et al. | |
| 7,037,070 | B2 * | 5/2006 | Raine et al. | 415/162 |
| 7,413,401 | B2 * | 8/2008 | Szucs et al. | 415/162 |
| 8,297,918 | B2 * | 10/2012 | Bhatnagar | 415/160 |

* cited by examiner

*Primary Examiner* — Edward Look
*Assistant Examiner* — William Grigos
(74) *Attorney, Agent, or Firm* — Krieg DeVault LLP

(57) ABSTRACT

A variable vane actuation system and method is disclosed herein. The variable vane actuation system includes a first ring member disposed for pivoting movement about a centerline axis. The first ring member is operably connected with at least one vane such that the at least one vane pivots in response to the pivoting movement of the first ring member. The variable vane actuation system also includes a first pin engaged with the first ring member. The variable vane actuation system also includes a ring moving device operably engaged with the first pin to move the first ring member about the centerline axis. The ring moving device includes at least one plate having a first slot and an actuator operable to move the at least one plate. The first pin is received in the first slot and is a cam follower to a cam defined at least in part by a surface of the first slot.

19 Claims, 4 Drawing Sheets

VARIABLE VANE ACTUATION SYSTEM AND METHOD

STATEMENT REGARDING FEDERALLY SPONSORED RESEARCH OR DEVELOPMENT

The U.S. Government has a paid-up license in this invention and the right in limited circumstances to require the patent owner to license others on reasonable terms as provided for by the terms of N00014-04-D-0068 awarded by the Department of Defense.

BACKGROUND OF THE INVENTION

1. Field of the Invention

The invention relates to a system for moving variable stator vanes, such as in a turbine engine for example.

2. Description of Related Prior Art

Variable pitch stator vanes can be used in the compressor sections of gas turbine engines, as well as the intake portion of the turbine engine. These vanes can be pivotally mounted inside a case of the turbine engine and can be arranged in circumferential rows that are spaced from one another along a centerline axis of the turbine engine. Each row can correspond to a different stage of the compressor section. Generally, each of the individual vanes can pivot on a first spindle about an axis that extends transverse to the centerline axis. Engine performance and reliability can be enhanced by varying the angle of the vanes at different stages during the operation of the turbine engine. For example, in a turbine engine applied to aircraft propulsion, obtaining greater thrust can require the compressor section to impart a higher pressure ratio to the fluid moving through the compressor. However, on the other hand, a higher pressure ratio can cause the compressor to stall or surge. Variable pitch stator vanes can be pivoted as the speed of the engine changes to ensure that each vane is in a position to guide the flow angle as a function of rotor speed to counteract the development of stall characteristics.

SUMMARY OF THE INVENTION

In summary, the invention is a variable vane actuation system and method. The variable vane actuation system includes a first ring member disposed for pivoting movement about a centerline axis. The first ring member is operably connected with at least one vane such that the at least one vane pivots in response to the pivoting movement of the first ring member. The variable vane actuation system also includes a first pin engaged with the first ring member. The variable vane actuation system also includes a ring moving device operably engaged with the first pin to move the first ring member about the centerline axis. The ring moving device includes at least one plate having a first slot and an actuator operable to move the at least one plate. The first pin is received in the first slot and is a cam follower to a cam defined at least in part by a surface of the first slot.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF EXEMPLARY EMBODIMENTS

Figure 1:
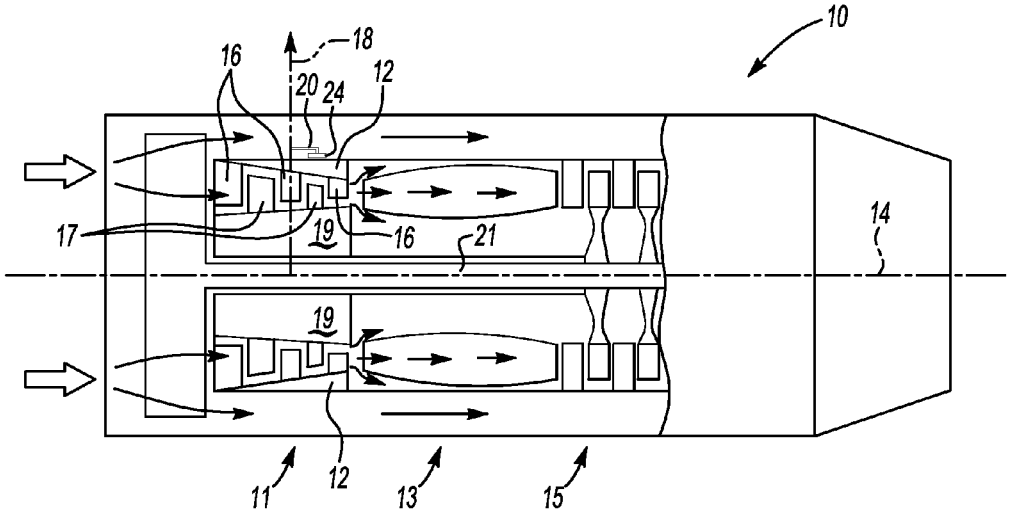
FIG. 1 is a schematic representation of a turbine engine incorporating an exemplary embodiment of the invention.

A plurality of different embodiments of the invention is shown in the Figures of the application. Similar features are shown in the various embodiments of the invention. Similar features have been numbered with a common reference numeral and have been differentiated by an alphabetic suffix. Also, to enhance consistency, the structures in any particular drawing share the same alphabetic suffix even if a particular feature is shown in less than all embodiments. Similar features are structured similarly, operate similarly, and/or have the same function unless otherwise indicated by the drawings or this specification. Furthermore, particular features of one embodiment can replace corresponding features in another embodiment or can supplement other embodiments unless otherwise indicated by the drawings or this specification.

The invention, as exemplified in the embodiment described below, can be applied to move or actuate a plurality of vanes in a turbine engine. Alternative embodiments of the invention can be applied in operating environments other than turbine engines. In a turbine engine, it can be desirable to vary the amount of fluid such as air entering the core engine. The intake portion of the turbine engine can include vanes that pivot between respective "fully open" positions to respective "minimally open" positions.

The inventor has observed that the amount of force resisting movement of the vanes can vary over the movement between the respective fully open positions and the respective minimally open positions. As a result, the actuator(s) that move the vanes can encounter variable resistance to moving the vanes and therefore the actuator(s) must be sized to overcome the maximum resistance force.

The embodiment described below redistributes the resistance force to allow the actuator(s) to be minimally sized. In other words, the embodiment can increase resistance loading at one or more positions along the length of travel of a plate driven by the actuator to reduce and offset resistance loading at one or more other positions along the length of travel of the plate.

FIG. 1 schematically shows a turbine engine 10 according to the exemplary embodiment of the invention. The turbine engine 10 includes a compressor section 11, a combustor section 13, and a turbine section 15. A rotor 21 of the turbine engine 10 extends along a centerline axis 14 and the sections 11, 13, 15 are disposed along the axis 14. The centerline axis 14 can be the central axis of the turbine engine 10.

A compressor casing 12 can enclose a portion of compressor section 11. The compressor section 11 can include a plurality of rotatable compressor blades 17 mounted on a hub 19. The compressor section 11 can also include a plurality of vanes 16. The vanes 16 and blades 17 can be arranged in alternating circumferential rows. For example, a first circumferential row can include a plurality of vanes 16 encircling the axis 14. A second circumferential row can be spaced from the first circumferential row along the axis 14 and include a plurality of blades 17 encircling the axis 14.

Each of the vanes 16 can be pivoted about an axis 18 extending radially in full or in part relative to the axis 14. The vane 16 is "variable" in that it can be positioned in a plurality of different positions about the pivot axis of its spindle. The vanes 16 can be supported by the compressor casing 12 for pivoting movement. Each vane 16 can be coupled to a vane link, such as vane link 20. Each vane link 20 can extend between a first end engaged with the vane 16 and a second end spaced from the first end.

The vane link 20 can be connected at the second end to a ring member 24. The ring member 24 can be operable to pivot about the centerline axis 14. The ring member 24 can be engaged with each of the second ends of the plurality of vane links 20. As a result, pivoting movement of the ring member 24 about the centerline axis 14 is transmitted through the plurality of vane links 20 to pivotally move each of the plurality of vanes 16 concurrently. The exemplary ring member 24 can extend 360 degrees about the centerline axis 14 or can extend less than 360 degrees in alternative embodiments of the invention.

Figure 2:
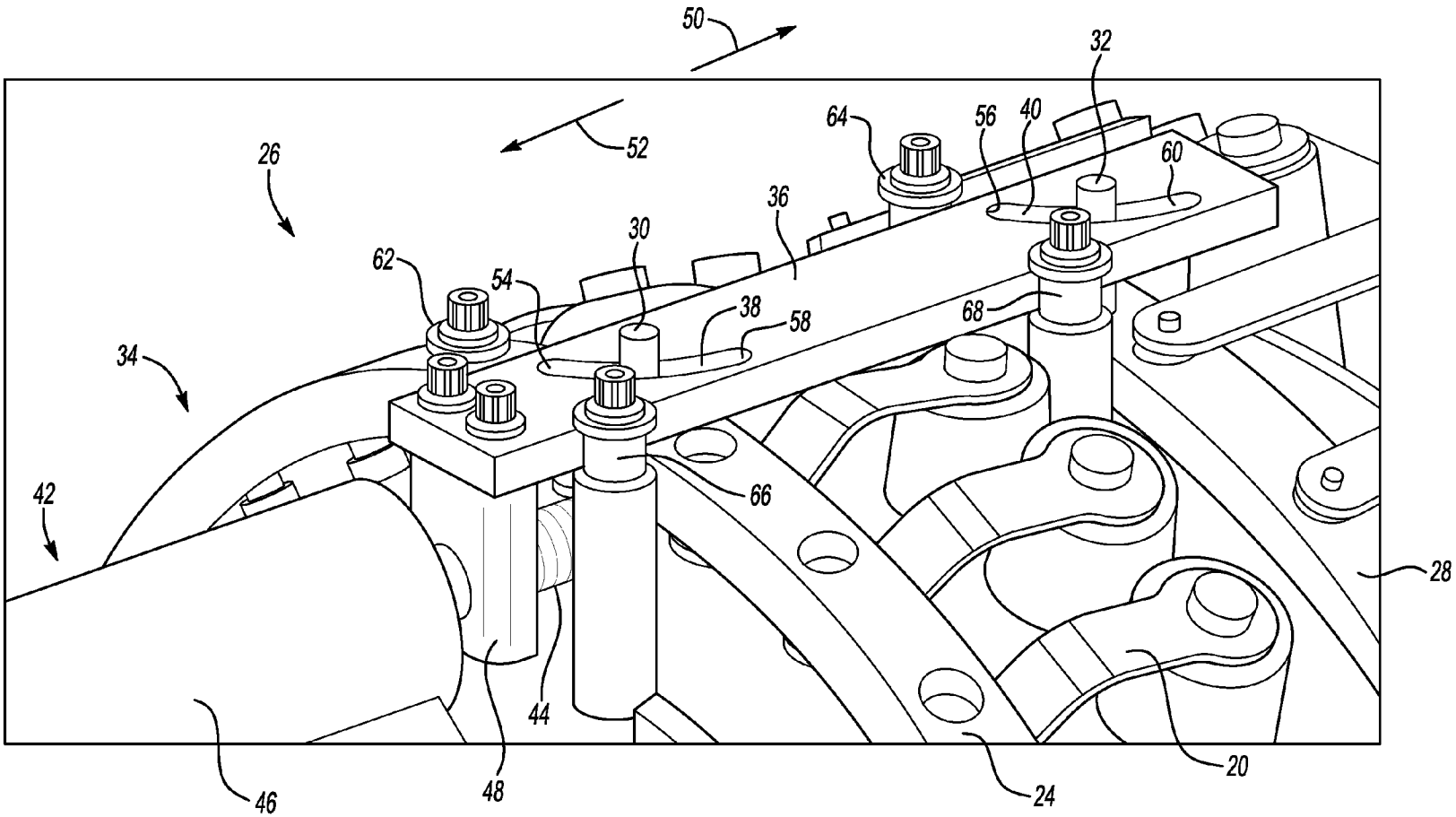
FIG. 2 is a perspective view of the exemplary embodiment shown schematically in FIG. 1.

FIG. 2 shows a perspective view of a variable vane actuation system 26 of the exemplary embodiment. The variable vane actuation system 26 includes the first ring member 24 disposed for pivoting movement about the centerline axis 14 (shown in FIG. 1). The first ring member 24 is operably connected with at least one vane (such as vane 16 in FIG. 1) such that the at least one vane pivots in response to the pivoting movement of the first ring member 24. The exemplary embodiment also includes a second ring member 28 disposed for pivoting movement about the centerline axis 14. The first and second ring members 24, 28 are spaced from one another along the centerline axis 14. The second ring member 28 is operably connected with at least one vane such that the at least one vane pivots in response to the pivoting movement of the second ring member 28. One or both of the first and second ring members 24, 28 can be fully or partially circular. Each of the first and second ring members 24, 28 can move different rows of vanes.

The variable vane actuation system 26 also includes a first pin 30 engaged with the first ring member 24. The exemplary first pin 30 can be fixed to the first ring member 24 and extend radially outward relative to the centerline axis 14. The variable vane actuation system 26 can also includes a second pin 32 engaged with the second ring member 28. The exemplary second pin 32 can be fixed to the second ring member 28 and extend radially outward relative to the centerline axis 14.

The variable vane actuation system 26 also includes a ring moving device 34 operably engaged with the first and second pins 30, 32 to move the first and second ring members 24, 28 about the centerline axis 14. The ring moving device 34 includes at least one plate 36 having a first slot 38. The first pin 30 is received in the first slot 38 and is a cam follower to a cam defined at least in part by the surface of the first slot 38. The plate 36 can also include a second slot 40. The second pin 32 is received in the second slot 40 and is a cam follower to a cam defined at least in part by a surface of the second slot 40.

The ring moving device 34 also includes an actuator 42 operable to move the at least one plate 36. The exemplary actuator 42 can include a drive screw 44 extending substantially parallel to the centerline axis 14. The drive screw 44 can be rotated by a motor 46. In alternative embodiments of the invention, the actuator can be pneumatic or hydraulic cylinder, or a linear electric actuator. The exemplary actuator 42 can also include a nut 48 fixed to the at least one plate 36 and threadingly engaged with the drive screw 44. Rotation of the drive screw 44 in a first angular direction results in the exemplary plate 36 moving parallel to the centerline axis 14 in a direction represented by arrow 50. Rotation of the drive screw 44 in a second angular direction opposite the first angular direction results in the plate 36 moving parallel to the centerline axis 14 in a direction represented by arrow 52, opposite to the direction represented by arrow 50.

It is noted that while the exemplary plate 36 moves rectilinearly, the plate 36 could move differently in other embodiments of the invention. The movement of the plate 36 can correspond to the shape of slots 38, 40. For example, a first end point or end limit of travel of the plate 36 can be defined when the pins 30, 32 are at respective first ends 54, 56 of the slots 38, 40. A second end point or end limit of travel of the plate 36 can be defined when the pins 30, 32 are at respective second ends 58, 60 of the slots 38, 40.

The plate 36 can be subjected to transverse loading in that various factors contribute to the resistance of movement of the first and second ring members 24, 28 about the centerline axis. In the exemplary embodiment, four bushings 62, 64, 66, 68 can be mounted around the plate 36 to keep the plate 36 on the path of intended movement. Since the slots 38, 40 function as cams to the cam follower pins 30, 32, the transverse loading on the plate 36 at least partially resists movement of the plate 36 along the intended path of movement. In some operating environments, the load tending to resist movement of the plate 36 can vary over the distance of travel of the plate 36.

Figure 3:
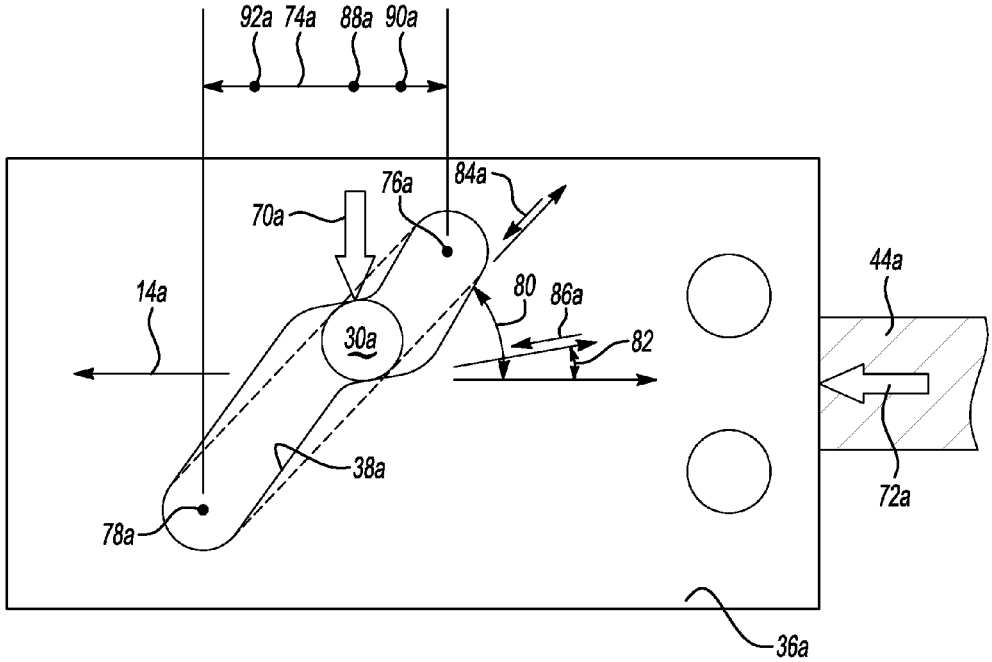
FIG. 3 is a plan view of a plate according to a second embodiment of the invention.

FIG. 3 shows an alternative embodiment of the invention having a plate **36*a* driven by a drive screw 44*a*. A pin 30*a* is received in a slot 38*a*. An arrow 70*a* represents loading associated with resistance to moving a ring member (not shown). An arrow 72*a* represents the input force of the actuator, which is supplied to move the plate 36*a*. The distance of rectilinear travel of the plate 36*a* is represented by arrow 74*a*. The exemplary slot 38*a*** extends along a torturous or non-straight path. The shape of a straight slot is shown in dash line for reference.

A straight slot would generally correspond to the pin **30*a* and the associated ring member moving at a constant angular velocity about the centerline axis, assuming the plate 36*a* moves at a constant rectilinear velocity over the distance of travel 74*a*. However, in the exemplary embodiment, the loading represented by arrow 70*a* is a maximum amount of loading and occurs when the pin 30*a* is at a point intermediate of first and second points of travel of the pin 30*a*, represented by points 76*a*, 78*a***.

The loading represented by arrow **70*a* can be transmitted to the plate 36*a* through the pin 30*a*. The loading 70*a* can include a first component normal to the slot 38*a* and a second component tangent to the slot 38*a*. In order to move the plate 36*a*, the actuator must overcome the second or tangential component of the loading 70*a*. The value of the second component corresponds to the angle of offset between the slot 38*a* and the centerline axis 14*a* at the point of loading along the plate travel distance 74*a*. For a straight slot, the angle is represented at 80. For the slot 38***a* at the point of loading 70*a*, the angle is represented at 82. The angle 82 is less than the angle 80.

Example 1

Assume the slot 38*a* was straight, the loading 70*a* is 2000 lbs., and the angle 80 is forty-five degrees. The second or tangential component of the loading 70*a*, represented by arrow 84*a*, that must be overcome to move the plate 36*a* would be:

(Tangential Loading 84*a*)=(Loading 70*a*)(sin)45°)= 1414 lbs.

Example 2

The slot 38*a* is non-straight as shown, the loading 70*a* is 2000 lbs., and the angle 82 is ten degrees. The second or tangential component of the loading 70*a*, represented by arrow 86*a*, that must be overcome to move the plate 36*a* would be: 347 lbs. Thus, the load resisting movement of the plate 36*a* is reduced by the deviating the shape of the slot 38*a* from straight to non-straight.

It is noted that loading tending to resist movement of the plate 36*a* will be increased at other locations along the path 74*a* of travel of the plate 36*a* by deviating the shape of the slot 38*a* from straight to non-straight. In the examples above, the maximum loading 70*a* occurs at a point 88*a* along the path or distance 74*a* of travel of the plate 36*a*. By deviating the slot 38*a* from being straight, the resistance to moving the plate 36*a* is decreased at the point 88*a*. At other points 90*a*, 92*a* along the path 74*a*, the resistance to movement will be increased relative to straight slot since the angle between the slot 38*a* and the centerline axis 14*a* will be increased. Thus, in the exemplary embodiment, loading is redistributed over the distance 74*a* of travel. The shape of the slot 38*a* is modified from being straight to channel/deflect the loading from relatively higher positions along the distance 74*a* to relative lower positions along the distance 74*a*. The load acting on the at least one plate 36*a* and resisting movement of the at least one plate 36*a* can be more evenly distributed over a length of travel 74*a* of the plate 36*a* in the exemplary embodiment.

It is also noted that shaping the slot 38*a* to be non-straight results in the ratio of a speed of rectilinear movement of the at least one plate 36*a* over the path 74*a* of travel to the speed of angular movement of the pin 30*a* and ring member about the centerline axis 14*a* being variable. Assuming the speed of rectilinear movement is constant, the speed of angular movement will be relatively lower when the angle between the slot 38*a* and the centerline axis 14*a* is relatively small. Conversely, the speed of angular movement will be relatively higher when the angle between the slot 38*a* and the centerline axis 14*a* is relatively large.

It is also noted that the exemplary embodiment set forth above is simplified. A single instance of relatively high loading is addressed. In alternative embodiments, multiple instances of relatively high loading can be addressed. The slot or slots in various embodiments of the invention can be shaped with as many bends as desirable to normalize loading that resists movement of the at least one plate 36*a* along the path of travel. Normalize can mean to make the force resisting movement of the plate 36*a* constant over the distance 74*a* of travel or can mean to either (1) minimize the standard deviation of the loading at positions along the distance 74*a* of travel of the plate 36*a* or (2) reduce the value between the maximum and minimum force levels along the distance 74*a* of travel of the plate 36*a*.

Figure 4:
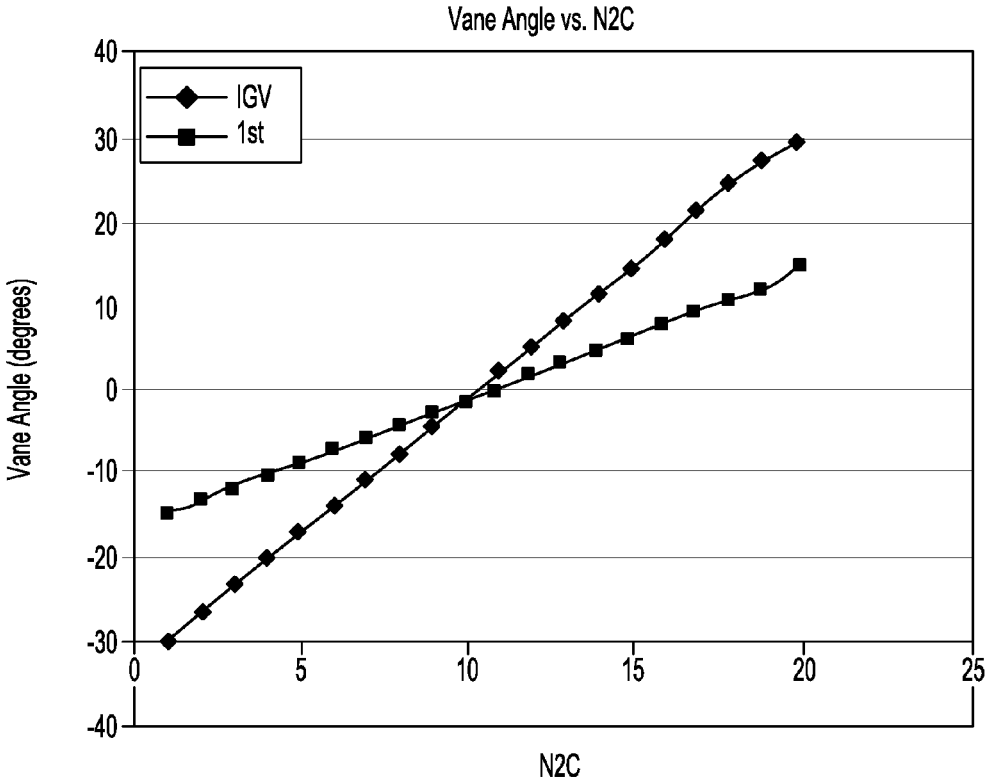
FIG. 4 is a first graph associated with a third embodiment of the invention in which the respective angles of two rows of vanes are plotted against the speed of rotor rotation (corrected)

FIGS. 4-7 are graphs associated with another embodiment of the invention. In FIG. 4, the y-axis corresponds to the respective angles of two rows of vanes. The first row of vanes can be inlet guide vanes (IGV) and the second row can be designated as the first row of compressor vanes (1st). The x-axis corresponds to the speed of rotation of the rotor. The speed can be corrected for variation in temperature. It is desirable maintain the relationship or shapes of the curves in the graph of FIG. 4 to precisely control the flow of fluid into the turbine engine.

Figure 5:
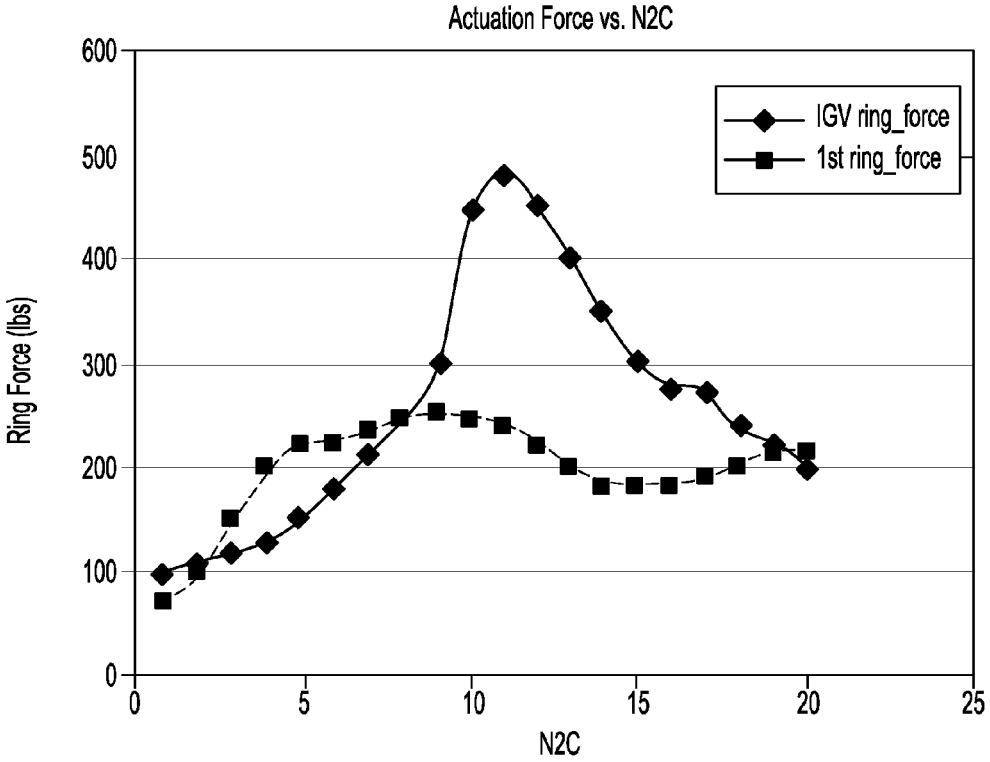
FIG. 5 is a second graph associated with the third embodiment of the invention in which the actuation force required to move each of two rings are plotted against the speed of rotor rotation (corrected)

In FIG. 5, the y-axis corresponds to the force exerted on the plate through the pins. The graph can represent the tangential component of the force (such as the forces represented by arrows 84*a* or 86*a* referenced above). The x-axis corresponds to the speed of rotation of the rotor, corrected. As shown in FIG. 5, the loading can vary over the range of rotor rotation. The range of rotor rotation corresponds to the distance of travel of the plate since the vane angle changes over the range of rotor rotation (as shown in FIG. 4) and the vane angle will change because of movement of the plate.

Figure 6:
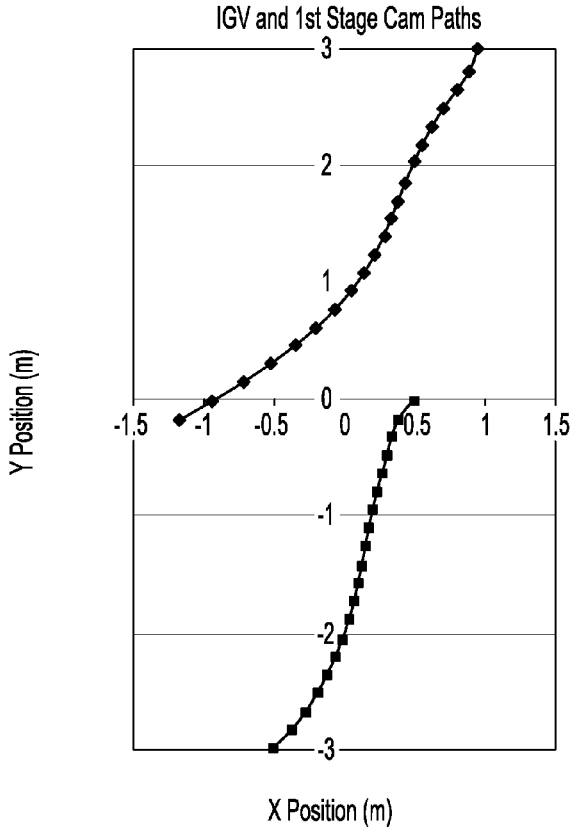
FIG. 6 is a third graph associated with the third embodiment of the invention in which paths or shapes of two slots are plotted over the surface of a plate.

In FIG. 6, the x-axis and y-axis represents the surface of a plate. Each data point represents positions of one of the pins along the path of travel for each pin. The curves connecting the respective series of data points correspond to the shapes of the respective slots 38*b*, 40*b*. As shown, the first and second slots 38*b*, 40*b* are differently shaped from one another and each extends along a respective torturous path.

Figure 7:
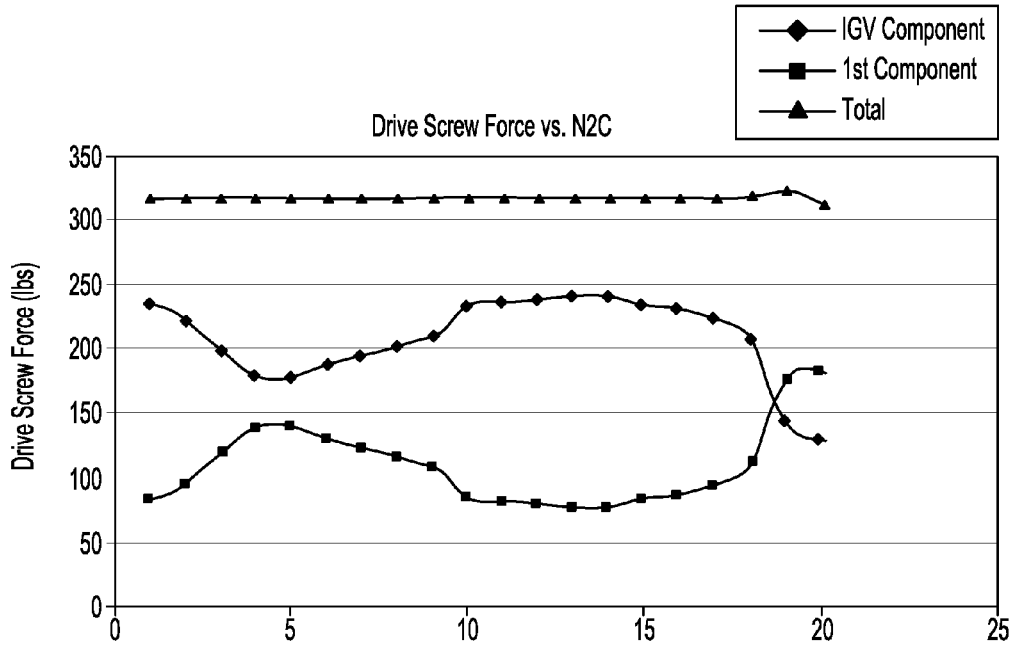
FIG. 7 is a fourth graph associated with the third embodiment of the invention in which the overall force require to move the plate and the individual forces for two rings are plotted against the speed of rotor rotation (corrected).

In FIG. 7, the resulting normalized force distribution is shown. FIG. 5 represents the forces based on a straight slot. FIG. 7 shows that the total force required to move the plate over the length of travel has been made substantially constant.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Further, the "invention" as that term is used in this document is what is claimed in the claims of this document. The right to claim elements and/or sub-combinations that are disclosed herein as other inventions in other patent documents is hereby unconditionally reserved.

What is claimed is:

1. A variable vane actuation system comprising:

a first ring member disposed for pivoting movement about a centerline axis and operably connected with at least one vane such that said at least one vane pivots in response to the pivoting movement of said first ring member;

a first pin engaged with said first ring member; and a ring moving device operably engaged with said first pin to move said first ring member about said centerline axis, wherein said ring moving device includes at least one plate having a first slot and an actuator operable to move said at least one plate over a path of travel, said first pin received in said first slot and being a cam follower to a cam defined at least in part by a surface of said first slot;

wherein said first slot extends along a path between first and second end points that is at least partially non-straight relative to a straight slot reference between said first and second end points;

wherein the first slot includes a middle straight portion at an intermediate point and first and second straight end portions at the respective first and second end points, wherein at the intermediate point the angle between the middle straight portion and the centerline axis is decreased relative to the angle between the straight slot reference and the centerline axis, and at the first and second end points the angle between the first and second straight end portions and the centerline axis is increased relative to the angle between the straight slot reference and the centerline axis.

2. The variable vane actuation system of claim 1 wherein said first slot is configured to normalize loading such that the force resisting movement of the at least one plate is substantially constant over the path of travel of the at least one plate.

3. The variable vane actuation system of claim 1 wherein said actuator further comprises:

a drive screw extending substantially parallel to said centerline axis; and a nut fixed to said at least one plate and threadingly engaged with said drive screw.

4. The variable vane actuation system of claim 1 further comprising:

a second ring member disposed for pivoting movement about said centerline axis and operably connected with at least one vane such that said at least one vane pivots in response to the pivoting movement of said second ring member, said second ring member spaced from said first ring member along said centerline axis;

a second pin engaged with said second ring member; and a second slot defined in said at least one plate, wherein said second pin is received in said second slot and being a cam follower to a cam defined at least in part by a surface of said second slot.

5. The variable vane actuation system of claim 4 wherein said first and second slots are differently shaped from one another.

6. The variable vane actuation system of claim 4 wherein both of said first and second slots extend along respective torturous paths.

7. The variable vane actuation system of claim 1 wherein said first pin extends from said ring member radially relative to said centerline axis.

8. A method for actuating a variable vane comprising the steps of:

disposing a first ring member operably connected with at least one vane for pivoting movement about a centerline axis such that the at least one vane pivots in response to the pivoting movement of the first ring member;

engaging a first pin with the first ring member;

operably engaging the first pin with a ring moving device to move the first ring member about the centerline axis, wherein the ring moving device includes at least one plate having a first slot and an actuator operable to move the at least one plate along a path of travel, said first pin received in said first slot and being a cam follower to a cam defined at least in part by a surface of said first slot; and forming said first slot to extend along a path between first and second end points that is at least partially non-straight relative to a straight slot reference between said first and second end points;

normalizing loading that resists movement of the at least one plate along the path of travel.

9. The method of claim 8 wherein the normalizing comprises one of:

making the force resisting movement of the at least one plate substantially constant over the path of travel; or minimizing the standard deviation of the loading at positions along the path of travel of the at least one plate; or reducing the value between the maximum and minimum force levels along the path of travel of the at least one plate.

10. The method of claim 8 further comprising the steps of:

moving the at least one plate along the path of travel between two end points during said operably engaging step; and forming the first slot to normalize loading such that the force resisting movement of the at least one plate is substantially constant along the path of travel of the at least one plate.

11. The method of claim 8 wherein said operably engaging step further comprises the steps of:

moving the at least one plate along the centerline axis over a predetermined length between first and second end limits of travel to move the first ring member about the centerline axis;

applying a variable load that resists movement of the at least one plate over the predetermined length through the first pin; and shaping the slot to be offset a first angle from the centerline axis at a first location along the predetermined length and to be offset from the centerline axis a second angle at a second location along the predetermined length, wherein the first angle is less than the second angle and the load acting on the at least one plate through the first pin at the first location is greater than loading acting on the at least one plate through the first pin at the second location.

12. The method of claim 8 wherein said operably engaging step further comprises the steps of:

moving the at least one plate rectilinearly over the path of travel between two end points to move the first ring member about the centerline axis;

shaping the slot such that a ratio of a speed of rectilinear movement of the at least one plate over the path of travel to a speed of angular movement of the first ring member about the centerline axis is variable.

13. The method of claim 8 further comprising the steps of:

moving the at least one plate along the path of travel between two end points during said operably engaging step; and deviating the shape of the slot from a straight line to a non-straight line to reduce a maximum loading resisting movement acting on the at least one plate over the path of travel.

14. The method of claim 8 further comprising the step of:

forming the slot to increase loading resisting movement on the at least one plate during movement of the at least one plate.

15. The method of claim 8 further comprising the steps of:

disposing a second ring member spaced from the first ring member along the centerline axis wherein the second ring member is operably connected with at least one vane for pivoting movement about the centerline axis such that the at least one vane pivots in response to the pivoting movement of the second ring member;

engaging a second pin with the second ring member; and operably engaging the second pin with the ring moving device to move the second ring member about the centerline axis, wherein the at least one plate includes a second slot, said second pin received in said second slot and being a cam follower to a cam defined at least in part by a surface of said second slot.

16. The method of claim 15 further comprising the step of:

designing the slots in view of one another to reduce a maximum loading resisting movement of the at least one plate over the path of travel of the at least one plate, the loading acting on the at least one plate through the first and second pins.

17. The method of claim 15 further comprising the step of:

deviating the shape of the first and second slots from both being straight to at least one being non-straight to normalize the load resisting movement of the at least one plate during pivoting movement of the first and second ring members.

18. The method of claim 15 further comprising the step of:

shaping the first and second slots such that one of the first and second slots is subjected to reduced loading tending to resist movement of the at least one plate at the expense of the other of the first and second slots being subjected to greater loading resisting movement of the at least one plate.

19. A turbine engine comprising:

first and second ring members each disposed for pivoting movement about a centerline axis and operably connected with at least one vane such that said respective vanes pivot in response to the pivoting movements of said first and second ring members;

first and second pins respectively engaged with said first and second ring members; and a ring moving device operably engaged with said first and second pins to move said first and second ring members about said centerline axis, wherein said ring moving device includes at least one plate having first and second slots and an actuator operable to move said at least one plate, said first pin received in said first slot and being a cam follower to a cam defined at least in part by a surface of said first slot and said second pin received in said second slot and being a cam follower to a cam defined at least in part by a surface of said second slot, wherein forces resisting movement of the first and second rings are transmitted to the at least one plate through the first and second pins;

wherein said first and second slots are shaped at least partially non-straight relative to a straight slot reference such that the load acting on the at least one plate and resisting movement of the at least one plate is more evenly distributed over a length of travel of the plate than if the first and second slots were not shaped non-straight relative to the straight slot reference;

wherein said first and second slots are shaped such that the total load acting on the at least one plate and resisting movement of the at least one plate over a length of travel of the plate is substantially constant.

* * * * *